United States Patent [19]

Antonioli

[11] Patent Number: 5,011,325

[45] Date of Patent: Apr. 30, 1991

[54] MODULAR ELEMENT FOR DEFINING AREAS AND ROUTES ON CARRIAGE ROADS AND THE LIKE

[75] Inventor: Giuseppe Antonioli, Bellinzona, Switzerland

[73] Assignee: Wirtgen AG, Switzerland

[21] Appl. No.: 404,339

[22] Filed: Sep. 7, 1989

[30] Foreign Application Priority Data

Mar. 31, 1989 [CH] Switzerland ..... 01183/89

[51] Int. Cl.[5] ..... E01F 13/00; E01F 15/00

[52] U.S. Cl. ..... 404/6; 256/13.1; 404/13

[58] Field of Search ..... 404/6, 13; 256/13.1

[56] References Cited

U.S. PATENT DOCUMENTS 4,059,362 11/1977 Smith ..... 404/6

4,773,629 9/1988 Yodock ..... 256/13.1

4,869,617 9/1989 Chiodo ..... 404/6

*Primary Examiner*—Stephen J. Novosad

*Attorney, Agent, or Firm*—Laff, Whitesel, Conte & Saret

[57] ABSTRACT

A modular element has an internally hollow body (2) made of plasstic material and exhibiting a parallelepiped horizontally-disposed configuration with a transverse section symmetrically diverging from a top portion (4) to a base portion (5). The opposite end surfaces (9, 11) of the body (2) are respectively provided with a coupling lug (8) and an engagement seat (10) matching the shape of said coupling lug. The coupling lug (8) of each modular element (1) is adaped to be fitted in the engagement seat (10) of a contiguous modular element (**1*b*) for the purpose of consecutively connecting several modular elements together. In an alternative embodiment a modular element (12) is provided, at its opposite sides, with two coupling lugs (8) each adapted to be fitted in an engagement seat (10) exhibited by a contiguous modular element (13**).

3 Claims, 2 Drawing Sheets

MODULAR ELEMENT FOR DEFINING AREAS AND ROUTES ON CARRIAGE ROADS AND THE LIKE

FIELD AND BACKGROUND OF THE INVENTION

The present invention relates to a modular element for defining areas and routes on carriage roads and the like, of the type comprising a plastics body having a substantially parallelepiped horizontally-disposed configuration the transverse section of which symmetrically diverges from a top portion towards a base portion coming in contact with and resting on the ground and joining means operating at the opposite ends of the body in order to allow the modular element to be joined in alignment with another modular element.

It is known that in roadways subjected to the passage of motor-vehicles and the like it is often necessary, for example due to maintenance works concerning the featheredge or for other reasons, to make the vehicles take a given route or, at all events, to define areas through which unauthorized vehicles cannot have access.

One of the most efficient solutions for the above purposes consists in using modular elements adapted to rest on the ground and consecutively connected to one another. In greater detail, each modular element has an inwardly hollow plastics body of a substantially parallelepiped horizontally-disposed configuration. The body has a transverse section symmetrically diverging away from a top portion towards a base portion which is the one allowing the modular element to rest on the ground. The mutual connection between the different modular elements is achieved by joining means operating at the opposite ends thereof.

Currently these joining means consists of two coupling lugs provided on the body of each modular element and respectively integral with opposite end walls of the body itself. Said coupling lugs disposed at the opposite ends of two adjacent modular elements, can be mutually joined by an intermediate element made of plastic material and provided, at the opposite ends thereof, with engagement seats matching the shape of the lugs and adapted to be engaged with said lugs by relative sliding.

The use of intermediate elements for the accomplishment of the connection between the different modular elements involves an increase in the production costs, due to the necessity of manufacturing said intermediate elements separately from the modular elements.

In addition, as said intermediate elements have rather small sizes, some of them can be inadvertently lost, which gives rise to problems when the modular elements are being assembled.

It has also been found that the connection between the modular elements through said intermediate elements does not always ensure a satisfactory steadiness to the structure thus achieved. As a result, in some cases it is necessary to arrange additional connection members for properly joining together the different modular elements. As a result there is a further increase in prices and the joining operation between the different modular elements becomes less feasible.

It is also to be pointed out that the additional connection members, usually consisting of suitably shaped metal rods or bars, can be dangerous should a vehicle accidentally impinge on the barrier formed by the mutually joined modular elements.

SUMMARY OF THE INVENTION

The main object of the present invention is to solve the drawbacks of the known art by providing a modular element adapted to be directly joined to another contiguous modular element and ensuring an excellent steadiness without needing the aid of intermediate elements or additional connection members.

The foregoing and further objects which will become more apparent from the following description are substantially attained by a modular element for defining areas and routes on carriage roads and the like, wherein said joining means comprises at least a coupling lug extending vertically in the region of one end surface of said body and exhibiting at least an undercut oriented towards said first end surface and at least an engagement seat extending vertically along a second end surface of the body and substantially matching the shape of the coupling lug, said engagement seat being designed to house the coupling lug of a contiguous modular element through the snap-fitting of said coupling lug in a substantially vertical direction.

BRIEF DESCRIPTION OF THE DRAWINGS

Further features and advantages will best be understood from the detailed description of a modular element for defining areas and routes on carriage roads and the like according to the present invention, given hereinafter by way of non limiting example with reference to the accompanying drawings, in which.

DESCRIPTION OF THE PREFERRED EMBODIMENTS

Figure 1:
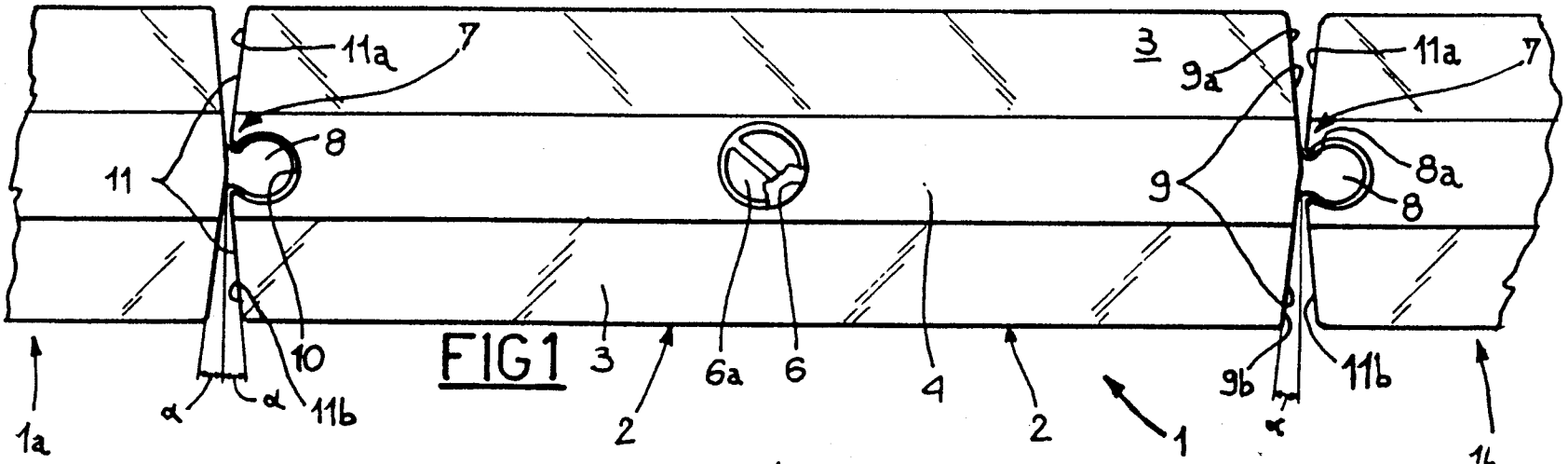
FIG. 1 is a fragmentary top view showing a modular element in accordance with the invention, joined to two contiguous modular elements, similar to the first one.

Referring to the drawings, 1 generally denotes a modular element for defining areas and routes on carriage roads and the like, in accordance with the present invention. Modular element 1 comprises an inwardly hollow body 2 preferably made of plastics, having a substantially parallelepiped horizontally-disposed configuration. In greater detail, said body 2 has a transverse section symmetrically diverging, by two inclined side walls 3, from a top portion 4 towards a base portion 5 coming in contact with and resting on the ground.

Body 2 can be provided, at the upper part thereof, with at least an opening 6, optionally provided with a removable plug **6*a* through which the body itself can be filled with water, sand or other ballasting material adapted to the modular element 1**.

As clearly shown in FIG. 1, the modular element 1 can be removably connected to other similar modular elements, identified by reference numerals **1*a* and 1*b* respectively, by joining means generally identified at 7**.

In an original manner the joining means 7 for each modular element 1, 1*a*, 1*b* substantially consists of at least a coupling lug 8 extending vertically at one end surface 9 longitudinally defining the body 2. Preferably the coupling lug 8 is disposed in the middle of the end surface 9 and has a cylindrical configuration or at all events it must be provided with at least an undercut 8*a* facing the first end surface itself.

Figure 3:
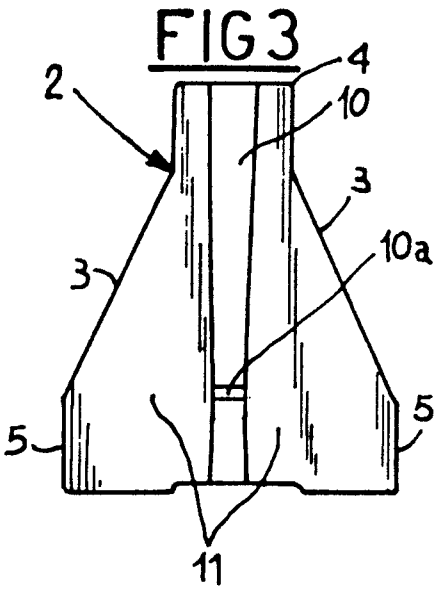
FIG. 3 is a side view taken from the left of the modular element shown in FIG. 2.
Figure 2:
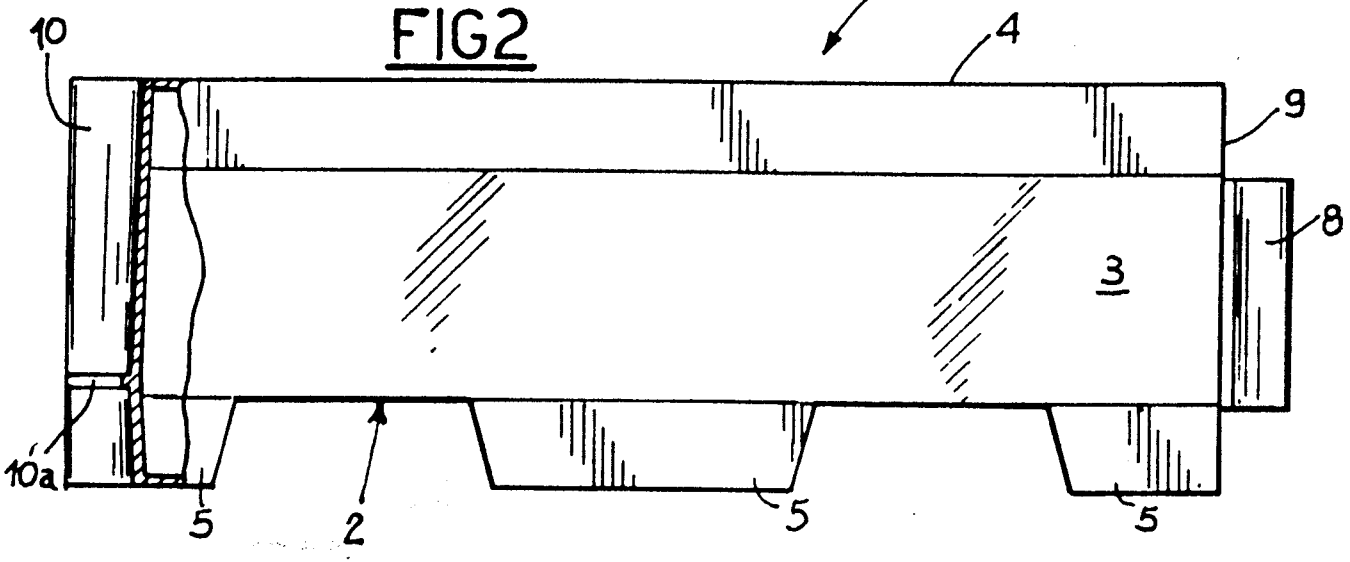
FIG. 2 is a partly sectional elevation view of the modular element.

The joining means 7 further comprises at least an engagement seat 10 substantially matching the shape of the coupling lug 8 and extending vertically along a second end wall 1 longitudinally defining the body 2 at the opposite side thereof with respect to the first end wall 9. Preferably, as clearly shown in FIGS. 2 and 3, the engagement seat 10 has a section gradually tapering towards a fitting portion 10*a* located flush with the coupling lug 8 and substantially having the same diameter as or a slightly smaller diameter than the latter, so that a snap-fit engagement is allowed.

Still referring to FIG. 1, preferably each end surface 9, 11 of body 2 should be symmetrically divided into two half parts 9*a*, 9*b* and 11*a*, 11*b* which symmetrically diverge thereby forming an angle with the perpendicular to the axis of main extension of the modular element.

The mode of use of the modular element according to the invention appears very simple.

Modular elements 1, 1*a*, 1*b* to be used for defining a given area or route on a carriage road are connected to each other in succession in mutual alignment by the joining means 7. In greater detail, the coupling lug 8 of each modular element is fitted, by forced sliding, into the engagement seat 10 provided on the modular element previously positioned on the roadway. Advantageously, as the engagement seat is of truncated conical form, the introduction of the coupling lug is facilitated.

By virtue of the particular conformation of the joining means 7 and the slightly angled extension of the end surfaces 9, 11, it is also possible to give the desired angular orientation to the different modular elements so that the barrier formed by them may have a curvilinear extension. Once they have been positioned, the modular elements can be filled with water or other materials through the filling openings 6.

Figure 4:
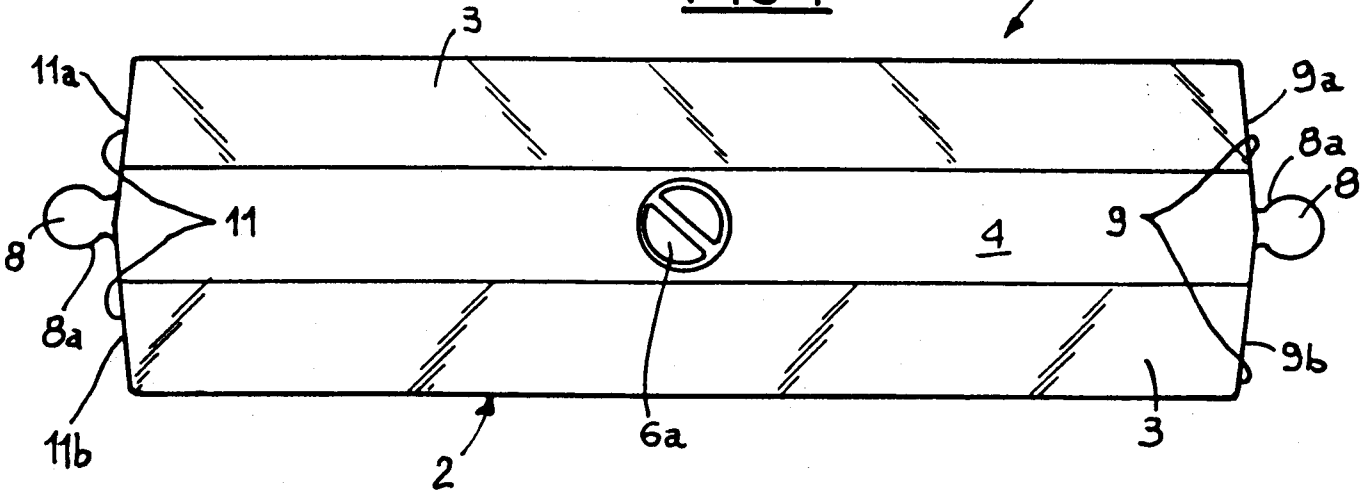
FIG. 4 is a top view of a possible alternative embodiment of the modular element shown in the preceding figures.
Figure 5:
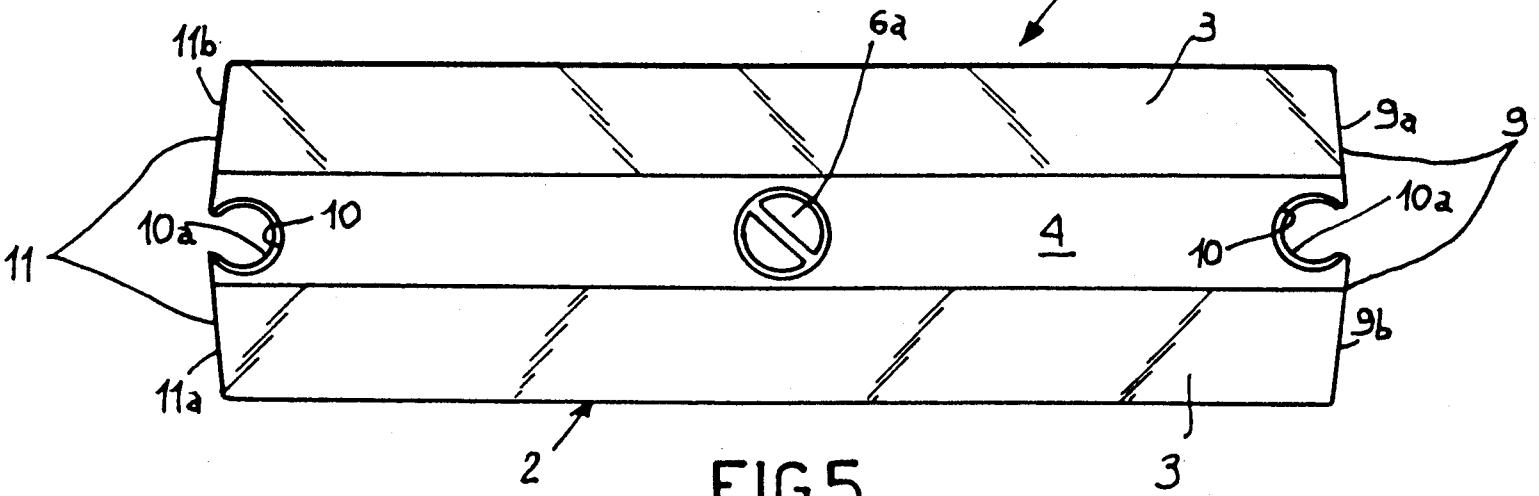
FIG. 5 is a top view of a modular element adapted to be consecutively associated with the one shown in FIG. 4.

In accordance with a possible alternative embodiment, FIGS. 4 and 5 show two modular elements, designated by reference numerals 12 and 13 respectively, designed to be used in combination. In said alternative embodiments the joining means consists of two coupling lugs 8 located at the opposite end surfaces 9, 11 of the first modular element 12, whereas the second modular element 13 is provided, on its opposite end surfaces 9, 11, with two engagement seats 10. It is clear that in this case two of said second modular elements 13 are connected to the first modular element 12 at the opposite sides thereof and that each second modular element 13 is then, in turn, followed by a first modular element and so on.

The present invention attains the intended purposes.

In fact the modular element can be joined to other modular elements without the aid of any intermediate connection element. As a result the assembling is easier and the assembled structure is steadier without being necessary to add additional connection members such as rods or the like, as in the known art.

The elimination of intermediate and additional connection members brings about an important reduction in the production costs and eliminates other practical drawbacks such as the possibility of missing some of said members.

Obviously modifications and variations can be made to the invention as conceived, all of them falling within the scope of the inventive idea characterizing it.

What is claimed is:

1. A modular element for defining areas and routes on roads and the like, comprising:

a plastic body having two opposite side walls joined by two ends, said side walls having a top portion, a base portion and a transverse section symmetrically diverging from said top portion towards a base portion;

joining means operating at opposite ends of said body to allow the modular element to be joined with a contiguous modular element;

said joining means having at one end a substantially cylindrical coupling lug integral with the plastic body, said cylindrical lug extending from and vertically along said one end surface of said body and having an undercut portion connecting the cylindrical portion with said one end surface, and at the other end a substantially cylindrical engagement seat formed in the other end, said seat extending vertically along said other end and being sized substantially complementary to said coupling lug wherein said coupling lug of said modular element is positively engageable in a pivotable relationship with the engagement seat of a contiguous modular element;

each end surface of the body being divided symmetrically into two half parts which diverge from each other to the side walls and form an angle with said side walls whereby a plurality of modular elements can be connected together to form barriers having a curvilinear shape.

2. A modular element for defining areas and routes on roads and the like, comprising:

a plastic body having two opposite side walls joined by two ends, said side walls having a top portion, a base portion and a transverse section symmetrically diverging from said top portion towards a base portion;

joining means operating at opposite ends of said body to allow the modular element to be joined with a contiguous modular element;

said joining means having at each end a substantially cylindrical coupling lug integral with the plastic body, said cylindrical lug extending from and vertically along said end surfaces of said body and having an undercut portion connecting the cylindrical portion with said end surface;

each end surface of the body being divided symmetrically into two half parts which diverge from each other to the side walls and form an angle with said side walls whereby a plurality of modular elements can be connected together to form barriers having a curvilinear shape; and said coupling lugs being sized substantially complementary to a seat formed in ends of said contiguous modular element wherein said coupling lug of said modular element is positively engageable in a pivotable relationship with the seat of the contiguous modular element.

3. A modular element for defining areas and routes on roads and the like, comprising:

a plastic body having two opposite side walls joined by two ends, said side walls having a top portion, a base portion and a transverse section symmetrically diverging from said top portion towards a base portion;

joining means operating at opposite ends of said body to allow the modular element to be joined with a contiguous modular element;

said joining means having at each end a substantially cylindrical engagement seat formed by said ends of the plastic body, said seat extending vertically along each end and being sized substantially complementary to a coupling lug extending from an end of said contiguous modular element wherein said coupling lug of said contiguous modular element is positively engageable in a pivotable relationship with the engagement seat; and each end surface of the body being divided symmetrically into two half parts which diverge from each other to the side walls and form an angle with said side walls whereby a plurality of modular elements can be connected together to form barriers having a curvilinear shape.

* * * * *